United States Patent [19]

Tanaka et al.

[11] Patent Number: 4,618,552

[45] Date of Patent: Oct. 21, 1986

[54] LIGHT RECEIVING MEMBER FOR ELECTROPHOTOGRAPHY HAVING ROUGHENED INTERMEDIATE LAYER

[75] Inventors: Shigemori Tanaka; Fumio Sumino, both of Tokyo; Hitoshi Toma, Kawasaki, all of Japan

[73] Assignee: Canon Kabushiki Kaisha, Tokyo, Japan

[21] Appl. No.: 700,973

[22] Filed: Feb. 12, 1985

[30] Foreign Application Priority Data

Feb. 17, 1984 [JP] Japan ..... 59-28273
Mar. 7, 1984 [JP] Japan ..... 59-42171

[51] Int. Cl.[4] ..... G03G 5/14

[52] U.S. Cl. ..... 430/60; 430/58; 430/4; 430/510; 430/945

[58] Field of Search ..... 430/2, 60, 510, 523, 430/4, 395, 946; 350/3.65, 162.24, 168

[56] References Cited

U.S. PATENT DOCUMENTS 3,871,881 3/1975 Mikelsons ..... 430/60

FOREIGN PATENT DOCUMENTS 3917748 8/1962 Japan .

*Primary Examiner*—John D. Welsh

*Attorney, Agent, or Firm*—Fitzpatrick, Cella, Harper & Scinto

[57] ABSTRACT

A light receiving member comprising an intermediate layer between a substrate of a metal of an alloy having a reflective surface and a photosensitive member, the reflective surface of said substrate forming a light-diffusing reflective surface, and the surface of said intermediate layer forming a rough surface. A light receiving member comprising a subbing layer having a light-diffusing reflective surface with an average surface roughness of half or more of the wavelength of the light source for image exposure provided between an electroconductive substrate and a photosensitive layer.

27 Claims, 3 Drawing Figures

LIGHT RECEIVING MEMBER FOR ELECTROPHOTOGRAPHY HAVING ROUGHENED INTERMEDIATE LAYER

BACKGROUND OF THE INVENTION

1. Field of the Invention

This invention relates to a light receiving member such as an electrophotographic photosensitive member, more particularly to a light receiving member suitable for an electrophotographic printer of the system in which a laser beam is subjected to imagewise line scanning, especially an electrophotographic photosensitive member for laser printer.

2. Description of the Prior Art

Heretofore, the laser beam which has been employed for an electrophotographic printer of the system by line scanning of laser beam was a gas laser with relatively shorter wavelength such as helium-cadmium laser, argon laser or helium-neon laser, and the electrophotographic photosensitive member used therefor was a CdS-binder type photosensitive layer having a large thickness or a charge transfer complex (IBM Journal of the Research and Development, January, 1971, P. 75–89). Accordingly, no multiple reflection of laser beam occurred within the photosensitive layer and hence no image of interference fringe pattern appeared practically during image formation.

Whereas, for the purpose of minituarization and designing at low cost of the device, a semiconductor laser has been utilized in recent years in place of the gas laser as mentioned above. Such a semiconductor laser, which has generally an oscillated wavelength in the longer wavelength region of 750 nm or higher, requires an electrophotographic photosensitive member having high sensitivity characteristic in the longer wavelength region, and electrophotographic photosensitive members for this purpose have been developed.

As the photosensitive member having sensitivity to the longer wavelength light (e.g. 600 nm or longer) known in the art, there may be included, for example, a lamination type electrophotographic photosensitive member having a laminated structure of a charge generation layer containing a phthalocyanine pigment such as copper phthalocyanine, aluminum chloride phthalocyanine, etc. and a charge transport layer, or electrophotographic photosensitive member using a selenium-tellurium film.

When such a photosensitive member having sensitivity to the longer wavelength light is mounted on an electrophotographic printer of the laser beam scanning system and subjected to laser beam exposure, an interference fringe pattern appears in the toner image formed, thus having a drawback that no good reproduced image can be formed. One of the reasons conceivable may be due to incomplete absorption of the laser with longer wavelength, which gives rise to right reflection of the transmitted light against the substrate surface and results in generation of multiple reflected light of the laser beam, with the result that interference occurs between such multiple reflected light and the reflected light on the surface of the photosensitive layer.

As the method for cancelling this drawback, it has heretofore been proposed to cancel multiple reflection occurring within the photosensitive layer by way of roughening of the surface of an electroconductive substrate employed in an electrophotographic photosensitive member according to the anodic oxidation method or the sant blast method, or providing a light-absorptive layer or a reflection preventive layer between the photosensitive layer and the substrate. However, no such method could cancel completely the interference fringe pattern appearing as a practical problem during image formation. Particularly, in the method wherein the surface of the electroconductive substrate is roughened, it is required to have an average surface roughness with a sufficient size in order to cancel the interference fringe pattern which appears during image formation. Whereas, according to the sand blast method, the maximum surface roughness will be increased as the average surface roughness is increased, and there is also a tendency that the amount of greater roughness is increased in the distribution of its roughness. For this reason, the portion with greater roughness will function as the portion for injecting carriers into the photosensitive layer, thus causing undesirable formation of white dots (black dots when employing a reversal developing system). Moreover, in the case of a great average surface roughness, it is difficult to produce electroconductive substrates having a roughened surface within a permissible range of average surface roughness with good yield in the same lot in manufacturing, and there remain a number of points to be improved. Also, in the method employing a light-absorptive layer or a reflection preventive layer, the interference fringe pattern cannot sufficiently be cancelled, and yet there is also involved the drawback that the manufacturing cost is increased.

SUMMARY OF THE INVENTION

An object of the present invention is to provide a novel light receiving member (e.g. electrophotographic photosensitive member), particularly an electrophotographic photosensitive member for laser printer, which has cancelled the drawbacks as described above.

Further, a primary object of the present invention is to provide an electrophotographic photosensitive member, which has cancelled the interference fringe pattern which appears during image formation and appearance of black dots during reversal developing at the same time and completely.

The present inventors, in view of the fact that roughening of the surface of a substrate to an extent necessary for cancelling the interference fringe pattern which appears during image formation will rather increase the number of white dots (which appear as black dots when employing reversal developing system) during image formation depending on the extent of the roughened surface to give a very bad copy, have found that by making the surfaces of the substrate and the electroconductive layer roughened to the extent as to generate no white dot or black dot as mentioned above, the interference fringe pattern can also be prevented at the same time, to accomplish the present invention.

Accordingly, such objects of the present invention can be achieved by a light receiving member comprising an intermediate layer between a substrate of a metal or an alloy having a reflective surface and a photosensitive member, the reflective surface of said substrate forming a light-diffusing reflective surface and the surface of said intermediate layer forming a rough surface, or by a light receiving member comprising a subbing layer having a light-diffusing reflective surface with an average surface roughness of half or more of the wavelength of the light source for image exposure provided between an electroconductive substrate and a photosensitive layer.

DETAILED DESCRIPTION OF THE PREFERRED EMBODIMENTS

The "average surface roughness" as herein mentioned refers to the value as measured by a universal surface shape measuring instrument, "SE-3C" produced by Kosaka Kenkyusho, Japan.

Figure 1:
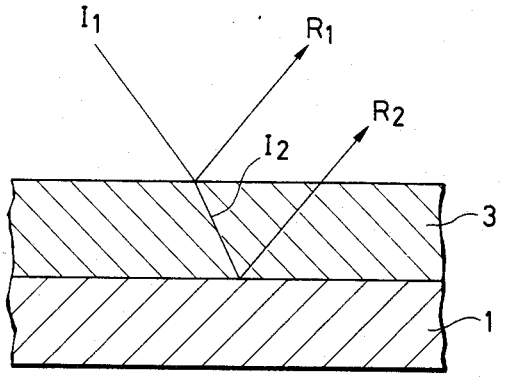
FIG. 1 is a sectional view of an electrophotographic photosensitive member of the prior art.
Figure 2:
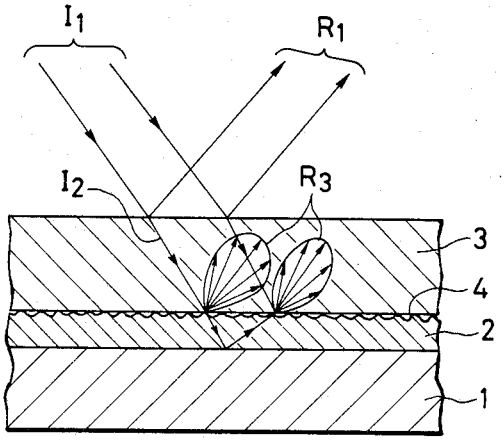
FIG. 2 and FIG. 3 are schematic illustrations showing the optical path of the light incident on the electrophotographic photosensitive member of the present invention.

FIG. 1 and FIG. 2 show schematically the embodiments when electrophotographic members are irradiated with a laser beam as the coherent light. FIG. 1 is an example when employing an electrophotographic photosensitive member of the prior art and FIG. 2 an example when employing the electrophotographic photosensitive member of the present invention.

In FIG. 1, when a laser beam $I_1$ is irradiated on the photosensitive layer 3 of an electrophotographic photosensitive member, a reflected light $R_1$ is generated on the surface of the photosensitive layer 3, and further the laser beam $I_2$ transmitted through the inner portion of the photosensitive layer 3 of the laser beam $I_1$ reaches the surface of the electroconductive substrate 1, where another reflected light $R_2$ is generated. Then, interference occurs between $R_1$ and $R_2$, and the reflected light $R_2$ gives rise to multiple reflections in the inner portion of the photosensitive layer 3, to result in appearance of an interference fringe pattern during image formation.

In contrast, in the embodiment of the present invention as shown in FIG. 2, a subbing layer 2 is formed between the electroconductive substrate 1 and the photosensitive layer 3, with the surface of the subbing layer 2 being subjected to roughening working to form a roughened surface 4. Thus, the light beam $I_1$ incident during image exposure is reflected against the surface of the photosensitive layer 3 to generate a reflected light $R_1$, while it is transmitted as the light $I_2$ through the inner portion of the photosensitive layer 3 to generate diffusing reflected light $R_3$ on the surface of the roughened surface 4. The diffusing reflected light $R_3$ also includes the light, which is transmitted through the inner portion of the subbing layer 2, reflected against the surface of the electroconductive substrate 1 and then generated again as the diffused light on the roughened surface 4. The diffusing reflected light $R_3$, by having an intensity at a ratio of 50% or more, preferably 60% or more, relative to the intensity of the incident light $I_1$, can inhibit the interference between the reflected light $R_2$ and the diffusing reflected light $R_3$ to the extent so as to enable cancellation of the interference fringe pattern during image formation.

For giving a diffusing reflected light $R_3$ having an intensity of 50% or more, preferably 60% or more, relative to the intensity of the incident light $I_1$, the roughened surface 4 of the subbing layer 2 is required to be set at $\lambda/2$ or more ($\lambda$: wavelength of incident light $I_1$), specifically at an average surface roughness of 0.5 um or more, preferably within the range from 0.6 um to 30 um.

When the ratio of the intensity of the diffusing reflected light $R_3$ to that of the incident light $I_1$ is 50% or below, the interference fringe pattern appearing during image formation cannot sufficiently be cancelled.

Also, if the average surface roughness of the roughened surface 4 is made more than 30 um, white dots or black dots will appear during, for example, image formation, whereby there is involved the problem that no good copied image can be obtained.

According to a preferred embodiment of the present invention, the roughened surface 4 formed on the subbing layer 2 should preferably be one utilizing the so called micro-phase separation phenomenon. Specifically, by coating an electroconductive substrate with a mixture of solutions of two resins with no or very small compatibility and, after drying, applying dissolving treatment with a solvent which can dissolve selectively one of the resins, a subbing layer 2 having a surface unevenness with any desired size and density can be provided. According to this method, the size of the unevenness constituting the roughened surface 4 can be controlled by the thickness of the coating, and its density by the mixing ratio of the two kinds of the resin solutions, and also with an advantage in cost.

As the combination of the resins constituting the subbing layer 2 having the roughened surface 4, there may be included those satisfying the following points:

(1) compatibility between the two resins should be small;

(2) the residual resin should have good adhesion to the electroconductive substrate;

(3) the residual resin should have good resistance to the solvent used in the above coated layers such as the photosensitive layer 3;

(4) the residual resin should have an electrical resistance of about $10^{13}$ ohm·cm or lower in terms of volume resistivity.

Specific examples of combination of resins satisfying the above conditions may include combinations of phenol resins with polyamide resins, combinations of epoxy resins with cellulose resins, etc., and the mixing ratio, which may differ depending on the size and density of the unevenness required, may preferably be about 5% to 30% of the resin to be dissolved away relative to the residual resin, with the film thickness being suitably about 0.3$\mu$ to 10$\mu$.

The subbing layer 2 having the roughened surface 4 of light-diffusing reflectivity is made of a phenol resin, a polyamide resin, an epoxy resin, a cellulose resin, etc., having a volume resistivity of $10^{13}$ ohm·cm or less, in order to maintain electroconductivity with the substrate, and can be provided according to the forming method as described above. For example, by mixing a phenol resin and a polyamide resin in an alcoholic solvent, a resin dispersion containing the polyamide resin solution dispersed as liquid droplets with diameters of about 1 to 3$\mu$ in the phenol resin solution can be obtained. The resin dispersion is applied on the electroconductive substrate 1, and after drying an curing, the coated substrate is dipped in a hot alcoholic solvent, whereby only the polyamide resin is dissolved away to obtain a coating of the cured phenol resin having an unevenness of about 1$\mu$on the electroconductive substrate 1. Thus, the surface 4 of the subbing layer 2 is made to have a surface roughness of $\lambda/2$ or more ($\lambda$: wavelength of the laser beam).

It is also possible in the present invention to provide another subbing layer (not shown) between the subbing layer 2 and the photosensitive layer 3, and it can be formed of, for example, casein, polyvinyl alcohol, nitrocellulose, ethyleneacrylic acid copolymer, polyamide (nylon 6, nylon 66, nylon 610, copolymerized nylon, alkoxymethylated nylon, etc.), polyurethane, gelatin, etc. The film thickness of this layer may appropriately be 0.1 μm to 5 μm, preferably 0.5 μm to 3 μm.

According to a preferred example of the present invention, the photosensitive layer 3 can be made to have a layered structure comprising a charge generation layer and a charge transport layer.

The charge generation layer in the present invention is formed by dispersing a charge generating material selected from azo pigments such as Sudan Red, Dian Blue, Janus Green B, etc.; quinone pigments such as Algol Yellow, Pyrene Quinone, Indanthrene Brilliant Violet RRP, etc.; quinocyanine pigments; perylene pigments; indigo pigments such as indigo, thioindigo, etc.; bisbenzoimidazole pigments such as Indofast Orange toner, etc.; phthalocyanine pigments such as copper phthalocyanine, Aluminochloro-phthalocyanine, etc.; quinacridone pigments; or azulene compounds in a binder resin such as polyester, polystyrene, polyvinyl butyral, polyvinyl pyrrolidone, methyl cellulose, polyacrylates, cellulose esters, etc. Its thickness may be about 0.01 to 1μ, preferably 0.05 to 0.5μ.

On the other hand, the charge transport layer may be formed by dissolving a positive hole transporting material selected from compounds having in the main chain or the side chain a polycyclic aromatic ring such as anthracene, pyrene, phenanthrene, coronene, etc. or a nitrogen-containing hetero ring such as indole, carbazole, oxazole, isoxazole, thiazole, imidazole, pyrazole, oxadiazole, pyrazoline, thiadiazole, triazole, etc., and hydrazone compounds in a resin having a film-forming property. This is because charge transporting materials are generally low in molecular weights and themselves poor in film-forming property. Such resins may include polycarbonate, polymethacrylates, polyarylate, polystyrene, polyester, polysulfone, styrene-acrylonitrile copolymer, styrene-methyl methacrylate copolymer, etc.

The thickness of the charge transport layer may be 5 to 20μ. It is also possible to form a photosensitive layer 3 with a structure having the charge generation layer as described above laminated on the charge transport layer.

The photosensitive layer 3 is not limited to the modes as described above, but there may also be employed, for example, photosensitive layers, in which a charge transfer complex comprising polyvinylcarbazole and trinitrofluorenone as disclosed in IBM Journal of the Research and Development, January, 1971, p. 75–p. 89 supra, or a pyrylium compound as disclosed in U.S. Pat. Nos. 4,315,983 and 4,327,169 is used, or a photosensitive layer containing a well-known inorganic photoconductive material such as zinc oxide or cadmium sulfide dispersed in a resin, or a vapor deposited film of selenium or selenium-tellurium, etc.

As the electroconductive substrate 1, a metal such as aluminum, copper, stainless steel, etc. or a plastic having a metal vapor deposited thereon may be suitable.

As the surface conditions of the substrate and the electroconductive layer to be used in the electrophotographic photosensitive member according to another preferred embodiment of the present invention, it may be possible to use one having an average surface roughness of λ/2 or more (λ: the wavelength of the incident light during image exposure) (preferably 0.5 μm to 30 μm, particularly preferably 0.3 μm to 20 μm).

As a preferable example of the present invention, the sum of the average surface roughness of the substrate and the average surface roughness of the electroconductive layer may suitably be λ/2 or more (λ: the wavelength of the incident light during image exposure), preferably 0.5 μm to 30 μm, particularly preferably 0.3 μm to 20 μm. It is thereby preferred to set the average surface roughness of the electroconductive layer at a value lower than that of the substrate, specifically at a value 70% or less, particularly preferably 10% to 40%, of the average surface roughness of the substrate.

Also, as the surface condition of the substrate or the electroconductive layer, it is suitable to use one in which about 1 to 30, preferably about 5 to 15, projections are formed per 1000 μm.

If the sum of the average surface roughness of the substrate and that of the electroconductive layer is in excess of 30 μm, the maximum surface roughness comes beyond 100 μm, and the barrier layer formed on the electroconductive layer cannot cover completely over the projected portions forming the roughened surface, whereby injection of carriers occurs at the projected portions into the photosensitive layer, with the result that the carrier injected portions appear as white dots undesirably during image formation (black dots appear in the case of reversal developing).

On the other hand, in the case of the sum of average surface roughnesses less than λ/2, generation of interference fringe pattern during image formation cannot sufficiently be cancelled.

As the roughening working method to be used in preparation of the electrophotographic photosensitive member of the present invention, there may be employed the sand blast method, the brush polishing method and the anodic oxidation method. Particularly, roughening can be effected by the sand blast method, in which glass beads of about 0.1 mm to 1 mm in diameter are blasted against the surface of a substrate or an electroconductive layer together with an air pressure of, for example, 1 kg/cm$^2$ to 10 kg/cm$^2$, or the method as disclosed in Japanese Patent Publication No. 5125/1982, namely the method in which the substrate after anodic oxidation treatment is dipped in an aqueous solution of an alkali metal silicate. The above anodic oxidation treatment may be practiced by passing current through an electroconductive substrate in an aqueous or non-aqueous solution of an inorganic acid such as phosphoric acid, chromic acid, sulfuric acid, boric acid, etc. or an organic acid such as oxalic acid, sulfamic acid, etc.

Figure 3:
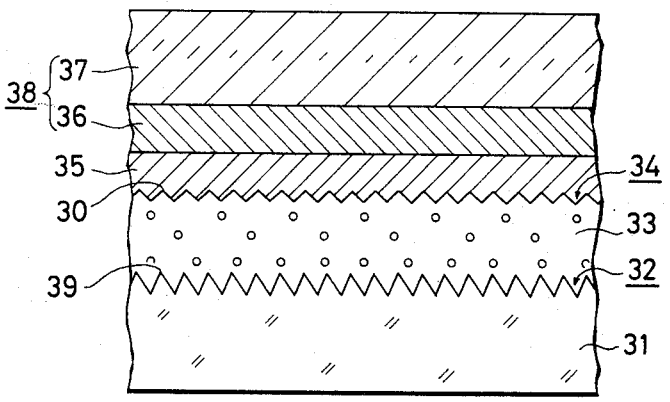

FIG. 3 represents an electrophotographic photosensitive member according to a preferred embodiment of the present invention. As the electroconductive substrate 31 having a roughened surface 32 on which projections 39 are formed, there may be employed a metal such as aluminum, brass, copper, stainless steel, etc., or a film having aluminum, tin oxide, indium oxide, etc. vapor deposited on a plastic such as polyester. Its shape may be either a cylinder, sheet or plate.

As the electroconductive layer 33 having a roughened surface 34 on which projections 30 are formed, it is possible to use a vapor deposited film of an electroconductive metal such as aluminum, tin, gold, etc. or coated film containing electroconductive powder dispersed in a resin. The electroconductive powder to be used in this case may include metallic powder of aluminum, tin, silver, etc., carbon powder and electroconductive pigments composed mainly of metal oxides such as titanium oxide, barium sulfate, zinc oxide, tin oxide, etc. A light absorber may also be contained in the electroconductive layer 33.

The resin for dispersing an electroconductive pigment may be any kind of resins, which can satisfy the conditions of (1) having firm adhesion to the substrate, (2) having good dispersibility of powder and (3) having sufficient solvent resistance. In particular, it is suitable to use thermosetting resins such as curable rubber, polyurethane resin, epoxy resin, alkyd resin, polyester resin, silicone resin, acrylic-melamine resin, etc. The resin containing an electroconductive pigment dispersed therein should have a volume resistivity of $10^{13}$ ohm·cm or less, preferably $10^{12}$ ohm·cm or less. For this purpose, it is desirable that the electroconductive pigment is contained at a proportion of 10 to 60% by weight in the coated film. As the method for dispersing electroconductive powder in a resin, it is possible to use conventional methods by means of roll mill, ball mill, vibrating ball mill, attritor, sand mill, colloid mill, etc. In the case when the substrate is shaped in a sheet, wire bar coating, blade coating, knife coating, roll coating or screen coating may suitably be employed, while dip coating is suitable in the case of a cylindrical substrate.

The electroconductive layer 33 may be formed to have a film thickness generally of 1 μm to 50 μm, preferably of 5 μm to 30 μm.

Between the electroconductive layer 33 and the photosensitive layer 38, there is provided a barrier layer 35 having the barrier function and the adhesion function. The barrier layer 35 may be formed of casein, polyvinyl alcohol, nitrocellulose, ethylene-acrylic acid copolymer, polyamide (nylon 6, nylon 66, nylon 610, copolymerized nylon, alkoxymethylated nylon, etc.), polyurethane, gelatin, etc.

The film thickness of the barrier layer 35 can be made to 2-fold or more of the average surface roughness of the roughened surface 34 formed on the electroconductive layer 33, specifically 0.1 to 10μ, preferably 0.5 to 5μ.

The photosensitive layer 38 can be made to have a layered structure comprising a charge generation layer 36 and a charge transport layer 37. The charge generation layer 36 is formed by dispersing a charge generating material selected from azo pigments such as Sudan Red, Dian Blue, Janus Green B, etc.; quinone pigments such as Algol Yellow, Pyrene Quinone, Indanthrene Brilliant Violet RRP, etc., quinocyanine pigments; perylene pigments; indigo pigments such as indigo, thioindigo, etc.; bisbenzoimidazole pigments such as Indofast Orange toner, etc.; phthalocyanine pigments such as copper phthalocyanine, Aluminochlorophthalocyanine, etc.; quinacridone pigments; or azulene compounds in a binder resin such as polyester, polystyrene, polyvinyl butyral, polyvinyl pyrrolidone, methyl cellulose, polyacrylates, cellulose esters, etc. Its thickness may be about 0.01 to 1μ, preferably 0.05 to 0.5μ.

On the other hand, the charge transport layer 37 may be formed by dissolving a positive hole transporting material selected from compounds having in the main chain or the side chain a polycyclic aromatic ring such as anthracene, pyrene, phenanthrene, coronene, etc. or a nitrogen-containing hetero ring such as indole, carbazole, oxazole, isoxazole, thiazole, imidazole, pyrazole, oxadiazole, pyrazoline, thiadiazole, triazole, etc., and hydrazone compounds in a resin having a film-forming property. This is because charge transporting materials are generally low in molecular weights and themselves poor in film-forming property. Such resins may include polycarbonate, polymethacrylates, polyarylate, polystyrene, polyester, polysulfone, styrene-acrylonitrile copolymer, styrene-methyl methacrylate copolymer, etc.

The thickness of the charge transport layer 37 may be 5 to 20μ. It is also possible to form a photosensitive layer 38 with a structure having the charge generation layer 36 as described above laminated on the charge transport layer 37.

The photosensitive layer 38 is not limited to the modes as described above, but there may also be employed, for example, photosensitive layers, in which a charge transfer complex comprising polyvinylcarbazole and trinitrofluorenone as disclosed in IBM Journal of the Research and Development, January, 1971, p. 75–p. 89 supra, or a pyrylium compound as disclosed in U.S. Pat. Nos. 4,315,983 and 4,327,169 is used, or a photosensitive layer containing a well-known inorganic photoconductive material such as zinc oxide or cadmium sulfide dispersed in a resin, or a vapor deposited film of selenium or selenium-tellurium, etc.

The electrophotographic photosensitive member of the present invention can be used for an electrophotographic system printer employing a semiconductor laser with a relatively longer wavelength (e.g. 750 nm or longer), but it is also suitable for use in electrophotographic system printers employing other laser beams such as helium-neon laser, helium-cadmium laser or argon laser. The present invention, in addition to the advantage of cancelling completely the interference fringe pattern during image formation which has appeared in the prior art method when employing a coherent light such as laser beam as the light source, has also the advantage of cancelling effectively the black dots.

That is, generally speaking, in an electrophotographic system printer employing a laser beam, a reversal developing system is employed, in which after charging of the electrophotographic photosensitive member, an electrostatic latent image is formed on a back image by giving laser beam a posi-imagewise scanning exposure (image scanning exposure) corresponding to image signals, and subsequently by giving a developer having a toner of the same polarity as the polarity possessed by the electrostatic latent image to the electrostatic latent image surface, the toner is attached onto the posiimagewise exposed portion subjected to image scanning. In the case of such a reversal developing system, unnecessary toner attachment occurred in black dots in the image formed. This is because no uniform roughened surface can be formed in the roughened surface formed by the sand blast method as described above, with a great distribution between the projections with small height and the projections with large height, whereby carriers are injected from the unnecessarily great projections into the charge generation layer to effect electrical neutralization between the carriers injected from the projections and the charges formed during charging, thus creating a state already electrically subjected to imagewise exposure, to give rise to attachment of the toner during development which causes formation of black dots.

In contrast, in the present invention, by use of an electroconductive substrate having a roughened surface and an electroconductive layer having a roughened surface, the interference fringe pattern which appeared during image formation in the prior art method and generation of black dots can be cancelled at the same time. This point is to be described in detail in the following Examples. Of course, the present invention is not limited to the reverse developing system, but various kinds of developing methods, such as the cascade developing method, the magnetic brush developing method, the powder cloud method, the jumping developing method and the liquid developing method and others may also be available.

The present invention is described by referring to the following Examples.

EXAMPLE 1

On the surface of a cylindrical aluminum of 60 mm in diameter and 258 mm in length, sand blast working was applied by blasting spherical glass beads powder with an average diameter of 0.5 mm containing 18% by weight of spherical glass beads of 1 mm or more in diameter under an air pressure of 5 kg/cm$^2$. The surface of the thus sand blast worked cylindrical aluminum was measured by a universal surface shape measuring instrument, "SE-3C" produced by Kosaka Kenkyusho to find that the average surface roughness was 8 $\mu$m.

Next, 25 parts by weight of titanium oxide (ECT-62, produced by Titanium Kogyo K.K.), 25 parts by weight of titanium oxide (SR-1T, produced by Sakai Kogyo K.K.) and 50 parts of a phenol resin (Plyofen J325, produced by Dainippon Ink K.K.) were mixed with 500 parts by weight of methanol and methyl cellosolve (methanol/methyl cellosolve=4 wt. parts/15 wt. parts) and stirred, followed by dispersion together with 50 parts by weight of glass beads of 1 mm in diameter by means of a sand mill dispersing machine for 10 hours.

The coating liquid for formation of electroconductive layer was applied by dipping on the surface of the sand blast worked cylindrical aluminum to a dried film thickness of 20 $\mu$m, followed by drying by heating, at 140° C. for 30 minutes, to form an electroconductive layer. The surface was measured by a universal surface shape measuring instrument "SE-3C" produced by Kosaka Kenkyusho to find that the average surface roughness was 1.5 $\mu$m.

Subsequently, 10 parts of a copolymerized nylon resin (trade name: Amilan CM-8000, produced by Toray K.K.) were dissolved in a mixture comprising 60 parts by weight of methanol and 40 parts by weight of butanol, and applied by dipping on the above electroconductive layer to provide a polyamide resin layer with a thickness of 3.5$\mu$ thereon.

As the next step, 1 part by weight of $\epsilon$-type copper phthalocyanine (Linol Blue ES, produced by Toyo Ink K.K.), 1 part by weight of a butyral resin (Eslec BM-2, produced by Sekisui Kagaku K.K.) and 10 parts by weight of cyclohexanone were dispersed in a sand mill dispersing machine containing 1 mm $\phi$ glass beads for 20 hours, and thereafter diluted with 20 parts by weight of methyl ethyl ketone. The dispersion was applied by dip coating on the polyamide resin layer previously formed to form a charge generation layer. The layer thickness was found to be 0.3$\mu$.

Then, 10 parts by weight of a hydrazone compound having the following formula:

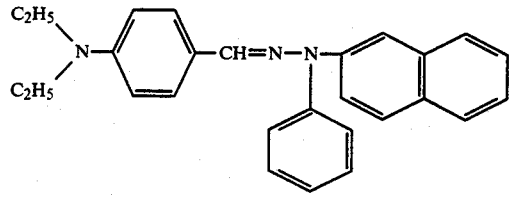

and 15 parts of a styrene-methyl methacrylate copolymer resin (trade name: MS 200, produced by Seitetsu Kagaku K.K.) were dissolved in 80 parts by weight of toluene. The solution was applied on the above charge generating layer and dried by hot air at 100° C. for one hour to form a charge transport layer with a thickness of 16$\mu$.

The thus prepared electrophotographic photosensitive member was mounted on Canon laser beam printer (LBP-CX, produced by Canon K.K.) which is a reversal developing system electrophotographic printer equipped with a semiconductor laser with an oscillated wavelength of 778 nm, and then line scanning was conducted on the whole surface to form an image of the whole surface with a black toner image. As the result, no interference fringe pattern appeared in the whole black image at all.

Next, the operation of forming letters as the image by line scanning of laser beam following letter signals was repeated for 2000 times under the conditions of a temperature of 15° C. and a relative humidity of 10%, and the copied letter image of the 2000th sheet was taken out. When the number of the black dots with diameters of 0.2 mm or more was measured in the copied letter image, no dot was found at all.

An electrophotographic photosensitive member was also prepared according to the same method except for changing the film thickness of the polyamide resin used in preparation of the above electrophotographic photosensitive member to 2 $\mu$m, and the same test was conducted. As the result, the number of black dots was found to be increased in the 2000th sheet of the copied letter image.

COMPARATIVE EXAMPLE 1

As the comparative test, in place of the cylindrical aluminum of which surface was worked by the sand blast method employed in preparation of the electrophotographic photosensitive member of Example 1, a cylindrical aluminum was employed having mirror surface characteristic, following otherwise entirely the same procedure as in Example 1, to prepare an electrophotographic photosensitive member.

The electrophotographic photosensitive member for comparative purpose was mounted on the laser beam printer employed in Example 1 and the same measurement was conducted. As the result, in the black image of the whole surface, a clear interference fringe was found to be formed.

COMPARATIVE EXAMPLE 2

The same cylindrical aluminum as employed in Example 1 was prepared, and the sand blast working was applied on the surface by blasting spherical glass beads powder with an average diameter of 0.5 mm containing 18% by weight of spherical glass beads of 1 mm in diameter under an air pressure of 9.5 kg/cm$^2$. The sand blast worked cylindrical aluminum surface was measured by a universal surface shape measuring instrument "SE-3C" produced by Kosaka Kenkyusho to find that the average surface roughness was 32 μm.

On this substrate were formed successively the electroconductive layer, the polyamide resin layer, the charge generation layer and the charge transport layer to form an electrophotographic photosensitive member for comparative purpose.

The electrophotographic photosensitive member for comparative purpose was mounted on the laser beam printer as employed in Example 1 and the same measurement was conducted. As the result, although no interference fringe pattern appeared in the black image of the whole surface, but black dots with diameters of 0.2 mm or more were found to be formed at a rate of about 30/10 $cm^2$ in the 2000th sheet of the letter copy.

EXAMPLE 2

Ten grams of fine particulate zinc oxide (Sazex 2000, produced by Sakai Kagaku K.K.), 4 g of an acrylic resin (Dianal LR 009, produced by Mitsubishi Rayon K.K.), 10 g of toluene and 10 mg of an azulenium compound represented by the following formula were mixed thoroughly in a ball mill to prepare a coating solution for photosensitive layer.

Azulenium compound:

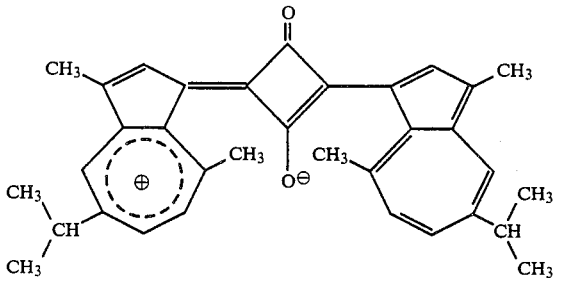

The coating solution for photosensitive layer was provided to a dried film thickness of 20 μm in place of the photosensitive layer of the layered structure comprising the charge generation layer and the charge transport layer as employed in Example 1, following otherwise the same procedure as in Example 1, to prepare an electrophotographic photosensitive member.

The electrophotographic photosensitive member was mounted on the laser beam printer employed in Example 1 (provided that the charger and the developer were changed so that the charging may be of the positive polarity and the toner of the positive polarity) and the same measurement was conducted. As the result, no interference fringe pattern was found in the black image of the whole surface, with no black dot with diameter of 0.2 mm or more being found in the copied letter of the 2000th sheet. Thus, very good images were found to be obtained.

EXAMPLE 3

The surface of a cylindrical aluminum of 60 mm in diameter and 258 mm in length was subjected to sand blast working by blasting spherical glass beads powder with an average diameter of 0.1 mm containing 8% by weight of spherical beads of 0.2 mm in diameter under an air pressure of 3 $kg/cm^2$. The surface was measured in the same manner as in Example 1 to find that its average surface roughness was 3 μm.

Next, 100 parts by weight of an electroconductive carbon paint (Dotite, produced by Fujikura Kasei K.K.) and 70 parts by weight of a melamine resin (Super-beckamine, produced by Dainippon Ink K.K.) were dissolved in 100 parts by weight of toluene. The solution was applied by dip coating on the aluminum cylinder subjected previously to sand blast working, followed by heat curing at 150° C. for 30 minutes, to provide an electroconductive layer with a film thickness of 6 μm thereon. The average surface roughness of this electroconductive layer was measured similarly as in Example 1 to be 2 μm.

Subsequently, on the electroconductive layer were provided successively the polyamide resin layer (with a thickness of 4.5 μm), the charge generation layer and the charge transport layer as employed in Example 1 to prepare an electrophotographic photosensitive member.

This was mounted on the laser beam printer as employed in Example 1 and images were formed similarly as in Example 1. As the result, no interference fringe pattern appeared in the black image of the whole surface at all, and no black dot was also found to appear at all in the copied letter image of the 2000th sheet.

When an electrophotographic photosensitive member was prepared according to the same procedure as described above except for changing the film thickness of the polyamide resin layer to 1.5 μm and the same test was conducted, the number of black dots was found to be increased in the copied letter image of the 2000th sheet.

COMPARATIVE EXAMPLE 3

On the cylindrical aluminum subjected to sand blast working employed in Example 3 was applied mirror surface working. The surface was measured according to the same method as in Example to find that its average surface roughness was 0.2 μm. Next, on the cylindrical aluminum were provided successively the electroconductive layer, the polyamide resin layer, the charge generation layer and the charge transport layer to prepare an electrophotographic photosensitive member for comparative purpose.

The electrophotographic photosensitive member for comparative purpose was mounted on the laser beam printer employed in Example 1 and images were formed similarly. As the result, interference fringe pattern was found to appear in the black image of the whole surface.

EXAMPLE 4

To 100 parts by weight of a methanolic solution of a phenol resin (solid content 60%: Plyofen 5010, produced by Dainippon Ink K.K.) were added 100 parts by weight of a methanolic solution of a copolymerized polyamide resin (solid content 10%: Amilan CM-8000, produced by Toray K.K.) and 12 parts by weight of a methanolic solution of p-toluenesulfonic acid, followed by thorough mixing and stirring. Then, the mixture was applied by the dipping method on an aluminum cylinder of 60 $\phi \times 258$ mm and cured by drying at 100° C. for 20 minutes to form a coating with a film thickness of 5μ. When this cylinder was dipped in methanol heated to 50° C. for 5 minutes, the polyamide component in the coating was dissolved away, thereby leaving only the phenol resin coated surface having an unevenness with an average surface roughness of about 1μto remain on the cylinder. The reflection characteristic of the cylinder was measured to find that the total light-diffusion reflectance was 66%. The average surface roughness was measured by means of a universal surface shape measuring instrument "SE-3C" produced by Kosaka Kenkyusho, and the ratio of the intensity of total diffusing reflected light relative to the incident light (total light-diffusing reflectance) was measured by means of "Uvidec-505" produced by Nippon Bunko K.K.

Next, an aqueous low fat casein (produced in New Zealand) was applied similarly by dipping to provide a casein resin layer on the above coating.

As the next step, 100 parts by weight of $\epsilon$-type copper phthalocyanine (produced by Toyo Ink K.K.), 50 parts by weight of a butyral resin (Eslec BM-2, produced by Sekisui Kagaku K.K.) and 1350 parts by weight of cyclohexanone were dispersed in a sand mill dispersing machine containing 1 mm $\phi$ glass beads for 20 hours. The dispersion was diluted with 2700 parts by weight of methyl ethyl ketone and applied by dip coating on the above polyamide resin, followed by drying by heating at 50° C. for 10 minutes to form a charge generation layer with a coated amount of 0.15 g/m$^2$.

Then, 10 parts by weight of a hydrazone compound having the following formula:

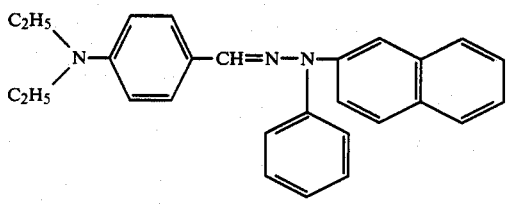

and 15 parts of a styrene-methyl methacrylate copolymer resin (trade name: MS 200, produced by Seitetsu Kagaku K.K.) were dissolved in 80 parts by weight of toluene. The solution was applied on the above charge generation layer and dried by hot air at 100° C. for one hour to form a charge transport layer with a thickness of 16$\mu$.

The thus prepared electrophotographic photosensitive member was mounted on Canon laser beam printer (LBP-CX, produced by Canon K.K.) which is a reversal developing system electrophotographic printer equipped with a semiconductor laser with an oscillated wavelength of 778 nm, and then line scanning was conducted on the whole surface to form an image of the whole surface with a black toner image. As the result, no interference fringe pattern appeared in the whole black image at all.

Next, the operation of forming letters as the image by line scanning of laser beam following letter signals was repeated for 2000 times under the conditions of a temperature of 15° C. and a relative humidity of 10%, and the copied letter image of the 2000th sheet was taken out. When the number of the black dots with diameters of 0.2 mm or more was measured in the copied letter image, no black dot was found at all.

COMPARATIVE EXAMPLE 4

As the comparative test, Example 4 was repeated except that the use of the phenol resin layer employed in preparation of the electrophotographic photosensitive member of Example 4 was omitted, to prepare an electrophotographic photosensitive member.

When the electrophotographic photosensitive member for comparative purpose was mounted on the laser beam printer employed in Example 1 and the same measurement was conducted, a clear interference fringe was found to be formed in the black image of the whole surface.

COMPARATIVE EXAMPLE 5

The same aluminum cylinder as employed in Example 4 was roughened on its surface according to the sand blast method. Next, on the surface of the roughened aluminum cylinder, a casein layer of 1 $\mu$m was provided directly with omission of the phenol resin layer employed in Example 4. The surface was measured by a universal surface measuring instrument "SE-3C" produced by Kosaka Kenkyusho to find that its average surface roughness was about 2 $\mu$m. The total light-diffusing reflectance relative to the intensity of incident light was then measured by "Uvidec-505" produced by Nippon Bunko K.K. to be 46%.

The electrophotographic photosensitive member for comparative purpose having the same photosensitive layer as in Example 4 provided on the casein layer was mounted on the laser beam printer as employed in Example 4 and the same measurement was conducted, whereby a clear interference fringe was found to be formed in the black image of the whole surface.

COMPARATIVE EXAMPLE 6

The same cylindrical aluminum as employed in Example 4 was prepared, and the sand blast working was applied on the surface to an average surface roughness was 32 $\mu$m, followed by provision of a 1 $\mu$m casein layer directly thereon with omission of the phenol resin layer employed in Example 4. The total light-diffusing reflectance relative to the incident light on this surface was measured similarly as in Example 4 to be 68%.

When the electrophotographic photosensitive member for comparative purpose having the same photosensitive layer as in Example 4 provided on the casein layer was mounted on the laser beam printer as employed in Example 4 and the same measurement was conducted, no interference fringe was found to be formed in the black image of the whole surface, but 30 black dots with diameters of 0.2 mm or more were found to be formed per 10 cm$^2$ of the copied letter image of the 2000th sheet, thus giving an image which can be viewed with extreme difficulty.

EXAMPLE 5

Ten grams of fine particulate zinc oxide (Sazex 2000, produced by Sakai Kagaku K.K.), 4 g of an acrylic resin (Dianal LR 009, produced by Mitsubishi Rayon K.K.), 10 g of toluene and 10 mg of an azulenium compound represented by the following formula were mixed thoroughly in a ball mill to prepare a coating solution for photosensitive layer.

Azulenium compound:

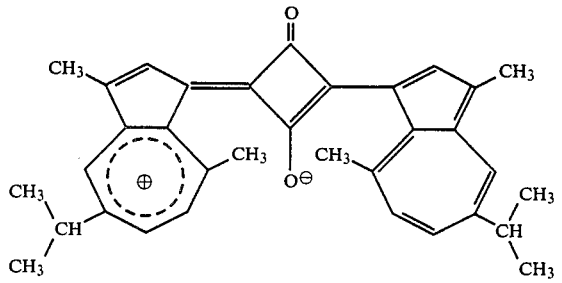

The coating solution for photosensitive layer was provided to a dried film thickness of 21 μm in place of the photosensitive layer of the layered structure comprising the charge generation layer and the charge transport layer as employed in Example 1, following otherwise the same procedure as in Example 1, to prepare an electrophotographic photosensitive member.

The electrophotographic photosensitive member was mounted on the laser beam printer employed in Example 1 (provided that the charger and the developer were changed so that the charging may be of the positive polarity) and the same measurement was conducted. As the result, no interference fringe pattern was found in the black image of the whole surface, with no black dot with diameter of 0.2 mm or more being found in the copied letter of the 2000th sheet. Thus, very good images were found to be obtained.

EXAMPLE 6

A phenol resin layer was formed according to the same procedure as in Example 4, except for changing the methanolic solution of the phenol resin to 50 parts by weight and the methanolic solution of the copolymerized polyamide resin to 150 parts by weight in the mixture of the methanolic solution of the phenol resin and the methanolic solution of the copolymerized polyamide resin.

The average surface roughness of this surface was measured according to the same method as in Example 4 to be 8 μm. Further, the total light-diffusing reflectance relative to the incident light was measured according to the same method as in Example 4 to be 78%.

Further, an electrophotographic photosensitive member was prepared by providing the same casein layer and the photosensitive layer as in Example 4 on the phenol resin layer as described above, and the same measurement as in Example 4 was conducted. As the result, no interference fringe pattern appeared in the image at all when a black image of the whole surface was formed. Also, when the 2000th sheet of copied letter image was taken out for observation of presence of black dot, no black dot was found to exist in the letter image.

According to the electrophotographic photosensitive member of this invention, no density irregularity in shape of an interference fringe occurs after image exposure and developing, but a clear electrophotograph can be obtained. Such an effect is marked, particularly when employing a coherent light, above all laser, as the light source for image exposure, and therefore it can be utilized very advantageously as an electrophotographic photosensitive member for laser printer.

What is claimed is:

1. A light receiving member comprising an intermediate layer between a substrate of a metal or an alloy having a reflective surface and a photosensitive layer, the reflective surface of said substrate forming a light-diffusing reflective surface, and the surface of said intermediate layer forming a rough surface having an average surface roughness of about 0.5 to 30 μm.

2. A light receiving member according to claim 1, wherein said metal or alloy is aluminum.

3. A light receiving member according to claim 1, wherein the light-diffusing reflective surface of said substrate has an average surface roughness of λ/2 or more (λ: wavelength of the incident light during image exposure).

4. A light receiving member according to claim 1, wherein the light-diffusing reflective surface of said substrate has an average surface roughness of 0.5 μm to 30 μm.

5. A light receiving member according to claim 1, wherein the light-diffusing reflective surface of said substrate has an average surface roughness of 0.3 μm to 20 μm.

6. A light receiving member according to claim 1, wherein the rough surface of said intermediate layer is formed by electroconductive powder dispersed in a resin which forms said intermediate layer.

7. A light receiving member according to claim 1, wherein the rough surface of said intermediate layer has an average surface roughness of λ/2 or more (λ: wavelength of incident light during image exposure).

8. A light receiving member according to claim 1, wherein the rough surface of said intermediate layer has an average surface roughness value less than the average surface roughness value of the light-diffusing reflective surface of said substrate.

9. A light receiving member according to claim 1, wherein the average surface roughness of said intermediate layer is 70% or lower of the average surface roughness of the light-diffusing reflective surface of said substrate.

10. A light receiving member according to claim 1, wherein the average surface roughness of said intermediate layer is 10% to 40% of the average surface roughness of the light-diffusing reflective surface of said substrate.

11. An electrophotographic photosensitive member for electrophotographic device employing laser beam as the light source comprising an intermediate layer between a substrate of a metal or an alloy having a reflective surface and a photosensitive layer, the reflective surface of said substrate forming a light-diffusing reflective surface, and the surface of said intermediate layer forming a rough surface having an average surface roughness of about 0.5 to 30 μm.

12. An electrophotographic photosensitive member according to claim 11, wherein said metal or alloy is aluminum.

13. An electrophotographic photosensitive member according to claim 11, wherein the rough surface of said intermediate layer and the light-diffusing reflective surface of said substrate have the function of preventing generation of an interference fringe pattern which appears during image formation.

14. An electrophotographic photosensitive member according to claim 11, wherein the rough surface of said intermediate layer is formed by electroconductive powder dispersed in a resin which forms said intermediate layer.

15. An electrophotographic photosensitive member according to claim 11, wherein said photosensitive layer has a laminated structure comprising a charge generation layer and a charge transport layer.

16. An electrophotographic photosensitive member according to claim 15, wherein said charge transport layer is laminated on the charge generation layer.

17. An electrophotographic photosensitive member according to claim 11, wherein said intermediate layer has an electroconductive layer having formed a rough surface and a barrier layer formed thereon.

18. An electrophotographic photosensitive member according to claim 11, wherein said laser beam is a laser beam emitted from a semiconductor laser.

19. A light receiving layer comprising a subbing layer having a light-diffusing reflective surface with an average surface roughness of about 0.5 to 30 μm provided between an electroconductive substrate and a photosensitive layer.

20. A light receiving member according to claim 19, wherein the electroconductive substrate having the subbing layer has optical characteristics which cause light-diffusing reflection at an intensity of 50% or more relative to the intensity of the light from the light source for image exposure.

21. A light receiving member according to claim 19, wherein the electroconductive substrate having the subbing layer has optical characteristics which cause light-diffusing reflection at an intensity of 65% or more relative to the intensity of the light from the light source for image exposure.

22. A light receiving member according to claim 19, which is formed by forming a coating separated in micro-phases by coating an electroconductive substrate with a mixture obtained by mixing solutions of two kinds of resins incompatible with each other, then removing one of said two kinds of resins by dissolution to form a rough surface with the remaining resin, followed by formation of a photosensitive layer thereon.

23. An electrophotographic photosensitive member for use in electrophotographic device provided with laser beam as the exposure light source, said electrophotographic photosensitive member comprising an electroconductive substrate, a photosensitive layer, and a subbing layer having an average surface roughness of about 0.5 to 30 μm between said electroconductive substrate and photosensitive layer.

24. An electrophotographic photosensitive member according to claim 23, wherein the electroconductive substrate having the subbing layer has optical characteristics which cause light-diffusing reflection at an intensity of 50% or more relative to the intensity of the laser beam from the light source for image exposure.

25. An electrophotographic photosensitive member according to claim 23, wherein the electroconductive substrate having the subbing layer has optical characteristics which cause light-diffusing reflection at an intensity of 65% or more relative to the intensity of the laser beam from the light source for image exposure.

26. An electrophotographic photosensitive member according to claim 23, which is formed by forming a coating separated in micro-phases by coating an electroconductive substrate with a mixture obtained by mixing solutions of two kinds of resins incompatible with each other, then removing one of said two kinds of resins by dissolution to form a rough surface with the remaining resin, followed by formation of a photosensitive layer thereon.

27. An electrophotographic photosensitive member according to claim 23, wherein said photosensitive layer has a laminated structure of a charge generation layer and a charge transport layer.

* * * * *